US005683744A

United States Patent [19]

Jolly et al.

[11] Patent Number: 5,683,744

[45] Date of Patent: Nov. 4, 1997

[54] PROCESS FOR THE PREPARATION OF A POROUS MATERIAL LAYER COVERED WITH AN ELECTRONICALLY CONDUCTIVE POLYMER AND THE PRODUCT OBTAINED BY THIS PROCESS

[75] Inventors: Renaud Jolly, Voreppe; Cornélia Petrescu, Grenoble, both of France

[73] Assignee: Commissariat a l'Energie Atomique, Paris, France

[21] Appl. No.: 530,377

[22] PCT Filed: Apr. 28, 1994

[86] PCT No.: PCT/FR94/00489

§ 371 Date: Oct. 23, 1995

§ 102(e) Date: Oct. 23, 1995

[87] PCT Pub. No.: WO94/25967

PCT Pub. Date: Nov. 10, 1994

[30] Foreign Application Priority Data

Apr. 30, 1993 [FR] France ..... 93 05147

[51] Int. Cl.[6] ..... B05D 5/12; B05D 3/00

[52] U.S. Cl. ..... 427/121; 427/177; 427/342

[58] Field of Search ..... 427/340, 341, 427/342, 121, 116, 177

[56] References Cited

U.S. PATENT DOCUMENTS 4,617,228 10/1986 Newman et al. ..... 427/121 X
4,847,115 7/1989 Warren et al. ..... 427/121
5,108,829 4/1992 Kuhn .
5,407,699 4/1995 Myers ..... 427/342 X

FOREIGN PATENT DOCUMENTS 0 206 414 12/1986 European Pat. Off. .
0 348 795 1/1990 European Pat. Off. .

OTHER PUBLICATIONS

Database WPI, Derwent Publications, AN-87-059938, JP-A-62-013435, Jan. 22, 1987.

*Primary Examiner*—James Engel
*Attorney, Agent, or Firm*—Oblon, Spivak, McClelland, Maier & Neustadt, P.C.

[57] ABSTRACT

The invention relates to a process for the preparation of a porous material layer covered with an electronically conductive polymer and to the product obtained by this process.

This process consists of placing the layer (1) on a support sheet (3) optionally having roughnesses or unevennesses (4), applying to the layer a polymerization solution comprising a monomer (pyrrole), an oxidizing agent ($FeCl_3$) and a doping agent (naphthalene disulphonic acid salt) using nozzles (6). The assembly is then wound up to form a composite roll (11), which is then immersed in the same polymerization solution for an adequate time to form a uniform, conductive polymer deposit (polypyrrole).

It is thus possible to obtain conductive textiles with surface resistances of 5 to 20 Ohm$^2$.

11 Claims, 2 Drawing Sheets

PROCESS FOR THE PREPARATION OF A POROUS MATERIAL LAYER COVERED WITH AN ELECTRONICALLY CONDUCTIVE POLYMER AND THE PRODUCT OBTAINED BY THIS PROCESS

BACKGROUND OF THE INVENTION

1. Field of the Invention

The present invention relates to a process for the preparation of layers of porous materials such as paper or textiles, covered with an electronically conductive polymer and in particular cloth layers.

It is used more particularly in the production of electricity conducting textiles having a low surface resistance of e.g. 5 to 20 $Ohm^2$, which can in particular be used as Joule effect heating elements or as electromagnetic shields.

More specifically, it relates to a process for depositing an electronically conductive polymer on a layer of porous material, e.g. paper or textile, by the in situ polymerization of a precursor monomer of the electronically conductive polymer by means of an oxidizing agent.

2. Discussion of the Background

Various processes for the deposition of electronically conductive polymers using in situ polymerization are known.

Thus, US-A-4 803 096 (Milliken Research Corp) describes a process for the production of electrically conductive textile materials by contacting the textile with an aqueous solution containing a monomer and an oxidizing agent in the presence of a counterion or a doping agent able to give an electrical conductivity to the polymer, under conditions such that in the solution is formed a prepolymer, which is adsorbed or deposited in the textile material, where it is polymerized so as to cover the cloth.

In this process it is possible to use doping agents constituted by sulphonic acid derivatives and in particular non-metallic oxidizing agents such as nitric acid, peroxides and persulphates.

With this process, a prepolymer is formed in the solution whose exact nature is not known and which is deposited by epitaxy on the fibres of the cloth. However, it is difficult to obtain a uniform thickness, particularly when it is wished to produce a conductive polymer covering on a large cloth or fabric. Thus, on using in this case method D described in column 13 of said document, which consists of immersing the wound cloth in a prepolymer solution, the latter does not completely penetrate the cloth and does not uniformly wet it, which cannot bring about a homogeneous thickness. Moreover, this process requires very long impregnation times for obtaining final, low, electric surface resistances of e.g. 3000 to 4000 $Ohm^2$ Thus, this process is not appropriate for the production of highly conductive textiles, e.g. having a surface resistance of 10 to 20 $Ohm^2$.

EP-A-206 133 (BASF) describes a process for depositing layers of conductive polymer (polypyrrole) on various materials by simultaneously or successively contacting the material with the precursor monomer (pyrrole), in liquid or gaseous form, and the dissolved oxidizing agent. This process also does not make it possible to obtain high electrical conductivities. Moreover, it requires the use of organic solvents, which leads to a rise in production costs and can be prejudicial to the environment. In addition, during the reaction, the polymer may polymerize in powder form, which reduces the polymer deposition efficiency on the material. It is also not very easy with this process to cover textile layers of great length, large amounts of solution being needed.

Bjorklund and Lundström in Journal of Electronic Materials, vol. 13, No. 1, 1984, pp 211–230 describe a paper impregnation process using polypyrrole, according to which the paper substrate is impregnated in an oxidizing agent solution and then the thus treated substrate is contacted with liquid or gaseous pyrrole.

As in the case of the preceding processes, the conductivities obtained are relatively low. In addition, the polypyrrole largely polymerizes in powder form, which reduces the efficiency of the polypyrrole deposited on the paper and large solution volumes are required for covering small paper surfaces, so that it is difficult to use the process industrially.

SUMMARY OF THE INVENTION

The present invention relates to a process for the production of layers of porous material covered with an electronically conductive polymer, which can be used on the industrial scale, in particular for producing highly conductive textiles with surface resistances of 10 to 20 $Ohm^2$.

The invention relates to a process for the preparation of a porous material layer covered with an electronically conductive polymer by in situ polymerization of a precursor monomer of the electronically conductive polymer by means of an oxidizing agent, characterized in that it comprises the following stages:

a) placing the porous material layer on an impermeable, flexible support sheet made from a material inert under the polymerization conditions of the precursor monomer, b) applying to the layer on the support sheet a polymerization solution comprising the precursor monomer, the oxidizing agent and a doping agent, c) winding the assembly formed by the support sheet and the thus treated layer in order to form a composite roll, d) introducing the composite roll into a container, e) filling the container with a polymerization solution comprising the precursor monomer, the oxidizing agent and the doping agent and f) maintaining the composite roll in the container filled with the polymerization solution for an adequate time to polymerize the precursor monomer and form on the layer a conductive polymer covering.

DETAILED DESCRIPTION OF THE PREFERRED EMBODIMENTS

In the process of the invention, the use of an impermeable support sheet, which then serves as a spacer, and the application beforehand to the layer, in stage b), of a certain quantity of polymerization solution, make it possible to ensure a better impregnation of the layer and consequently form thereon a more uniform conductive polymer covering, which gives the layer a better electrical conductivity.

Preferably, in the process according to the invention, use is made of a support sheet having roughnesses or unevennesses, so as to provide between the support sheet and the porous material layer a space in which a liquid can be retained.

The use of such a support sheet is particularly advantageous, because it ensures a better contact between the wound layer and the polymerization solution in stage f).

According to the invention, the porous material layers to be covered can be constituted by polymer films, e.g. of polyvinyl chloride, polystyrene or polyethylene, paper or synthetic, natural, artificial, mineral, woven or unwoven textiles.

As examples of such textiles reference can be made to polyester fabrics, polyamide fabrics such as nylon, acrylic fabrics and natural fabrics, such as those made from cotton, wool and other natural fibres.

It is also possible to use in the invention fabrics of glass, carbon fibres or other mineral materials, e.g. ceramics.

The support sheet used in the invention must be impermeable and flexible, so that on the one hand it can serve as a spacing sheet retaining a certain liquid quantity and on the other can be wound with the layer to be covered in order to form a composite roll.

It must also be inert under the conditions used for the in situ polymerization of the precursor monomer, i.e. it must not react with the layer to be covered, the precursor monomer, the oxidizing agent and the other components of the polymerization solution. For example, the support sheet can be made from a plastics material, e.g. polyethylene.

When said sheet has roughnesses, the latter can be formed by air bubbles, or by an embossing of the sheet.

The process according to the invention can be used for performing an electronically conductive polymer deposit from various oxidation-polymerizable, precursor monomers. Examples of such precursor monomers are pyrrole, aniline, thiophene and their derivatives.

For forming a conductive polymer from said precursor monomers, use is made of a polymerization solution comprising the monomer, an oxidizing agent and a doping agent.

Preferably, the polymerization solution is an aqueous solution, which is advantageous because aqueous solutions are less expensive and less polluting than organic solutions.

The oxidizing agent present in the polymerization solution can be constituted by one of the oxidizing agents normally used for the polymerization of monomers of this type. As examples of such agents, reference can be made to compounds of polyvalent metal ions such as $FeCl_3$, $Fe_2(SO_4)_3$, $K_3(Fe(CN)_6)$, $H_3PO_4$ $12MoO_3$, $H_3PO_4.12WO_3$, $CrO_3$, $(NH_4)_2Ce(NO_3)_6$.

It is also possible to use non-metallic oxidizing agents, e.g. nitric acid, 1,4-benzoquinone, tetrachloro-1,4-benzoquinone, hydrogen peroxide, peroxyacetic acid, peroxybenzoic acid, 3-chloroperoxybenzoic acid, ammonium persulphate, ammonium perborate, etc. Preferably $FeCl_3$ is used as the oxidizing agent.

According to the invention, use is also made in the polymerization solution of a doping agent, i.e. a compound having an anion able to dope the polymer formed in order to further improve the electrical conductivity and stability of the layer covered with the conductive polymer obtained at the end of the operation.

This doping agent is chosen so as to buffer the solution, in order to ensure that it does not have an excessively low pH, which has prejudicial consequences for the electrical conductivity and stability of the treated layer. Good results are obtained when the doping agent is constituted by sulphonic acid or a sulphonic acid salt, particularly ferric salts and disodium salts of naphthalene disulphonic acids, such as 1,5-naphthalene disulphonic acid and 2,6-naphthalene disulphonic acid.

In the polymerization solution, the concentrations of the monomer, oxidizing agent and doping agent are chosen as a function of the compounds used and the result which it is wished to obtain.

Generally, the monomer concentration is in the range $10^{-3}$ mole/l to 1 mole/l. The oxidizing agent concentration is in the range $10^{-3}$ to 1 mole/l. The doping agent concentration is in the range $10^{-3}$ to 1 mole/l.

When the polymerization solution is an aqueous solution of pyrrole, ferric chloride and disodium salt or naphthalene disulphonic acid ferric salt, these concentrations are advantageously as follows:

$10^{-1}$ to 1 mole/l of pyrrole, $10^{-1}$ to 1 mole/l of $FeCl_3$ and $10^{-2}$ to $10^{-1}$ mole/l of naphthalene disulphonic acid salt.

According to the invention, the polymerization solution is preferably prepared at the time of its use by mixing a first aqueous solution of the precursor monomer and the doping agent with a second aqueous solution of the oxidizing agent. This avoids the formation in the polymerization solution of a prepolymer or a polymer liable to precipitate in the solution instead of being deposited on the layer to be covered.

According to a performance variant of the process according to the invention, stages e) and f) are repeated at least once after washing the composite roll with water in order to eliminate excess conductive polymer not retained by the layer. This makes it possible to deposit more conductive polymer on the layer and further improve its electrical conductivity.

To perform the process according to the invention, the operation of depositing the conductive polymer on the layer, i.e. stage f) of maintaining the composite roll in the polymerization solution at ambient temperature or at a temperature above or below the latter.

It is preferable to work at a temperature below ambient temperature, e.g. t 5° to 10° C., in order to slow down the polymerization reaction kinetics and aid the impregnation of the layer by the monomer before it is polymerized.

The duration of said stage is also chosen as a function of the result which it is wished to obtain, i.e. the conductive polymer quantity deposited on the layer. Generally this stage lasts 0.1 to 24 h.

Following this deposition operation, which can be repeated several times as stated hereinbefore, the treated layer is separated from the support sheet and is then washed and dried, e.g. in a tepid air flow.

The invention also relates to layers of porous material covered with a conductive polymer obtained by this process, in particular textile layers, e.g. of polyester, covered with polypyrrole and having an electrical resistance of 5 to 45 $Ohm^2$.

DESCRIPTION OF THE DRAWINGS

Other features and advantages of the invention can be gathered from reading the following illustrative and non-limitative description with reference to the attached drawings, wherein show:

In FIG. 1, the layer 1 to be covered and coming from a roll 2 is placed on an impermeable, flexible support sheet 3 having roughnesses or unevennesses 4 and which can come from a roll 5.

Figure 1:
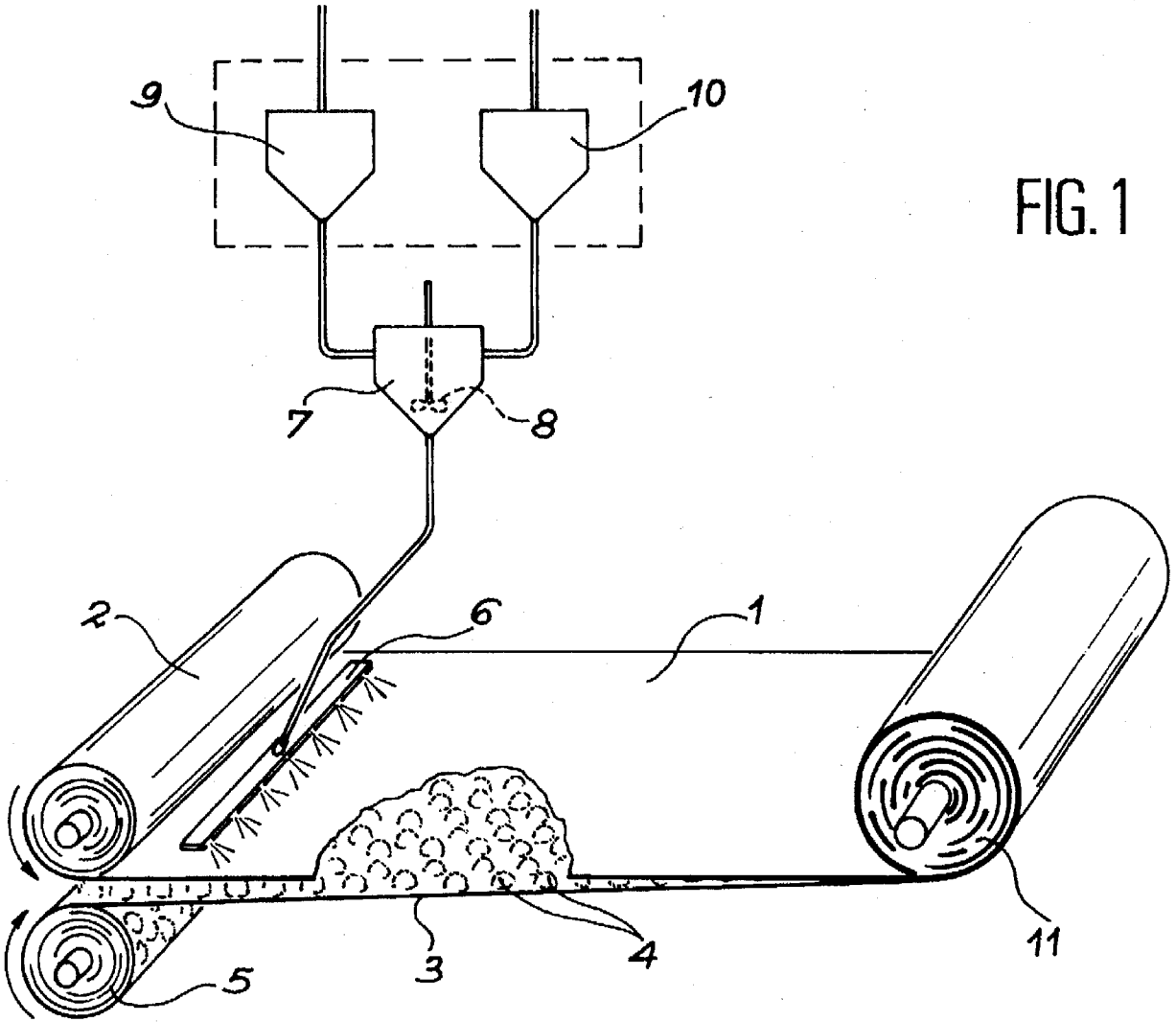
FIG. 1 A diagrammatic view of an installation used for performing the first three stages of the process according to the invention.

According to the invention, to the layer 1 on the support sheet 3 is applied a polymerization solution comprising the precursor monomer, the oxidizing agent and a doping agent using spraying nozzles 6, which are supplied by a tank 7 equipped with a stirring system 8. The tank 7 is supplied by two tanks 9 and 10, which respectively contain a first aqueous solution of monomer and doping agent (tank 9) and a second aqueous solution of oxidizing agent (tank 10). Thus, the polymerization solution is prepared at the time of use by mixing two solutions from the tanks 9 and 10 in order to prevent a prepolymer or a polymer from forming and being precipitated in the solution.

Following the application of the polymerization solution, the impregnated solution layer 1 and the support sheet 3 are wound together to form the composite roll 11, which is able to retain a certain polymerization solution quantity between the layer 1 and the support sheet 3 serving as a spacer.

Figure 2:
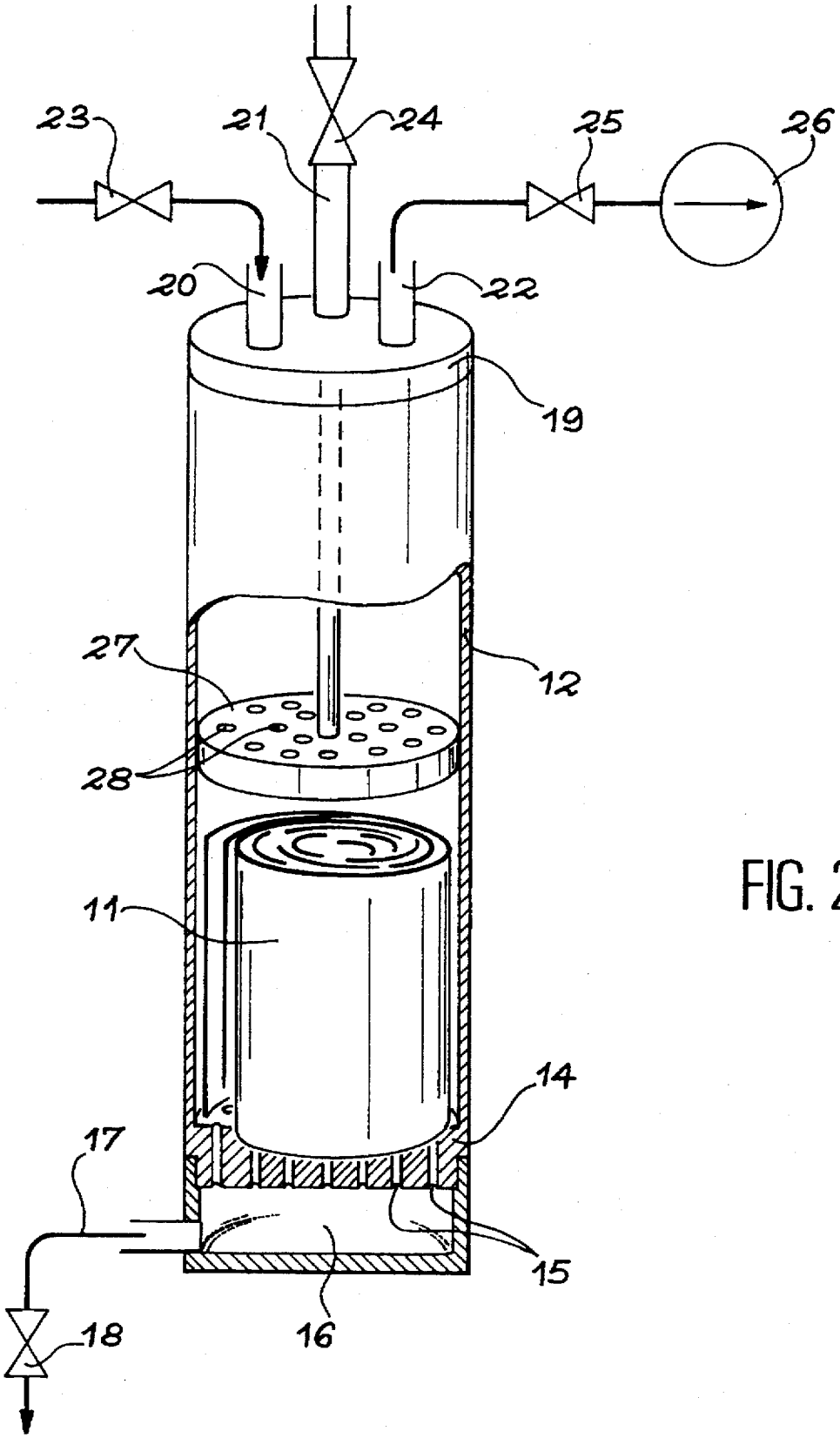
FIG. 2 A diagrammatic view of a cylindrical container usable for performing the final stages of the process according to the invention.

Following this operation, the composite roll 11 is placed in a cylindrical container 12 shown in FIG. 2. This container has at its base a support 4 with holes 15 for retaining the composite roll 11 and for permitting a liquid in the container to flow into a cavity 16 formed below the support 14 and having a draining pipe 17 equipped with a valve 18. In its upper part, the container is tightly sealed by a cover 10 having three ducts 20, 21, 22, respectively equipped with valves 23, 24 and 25.

The duct 20 can be connected to a polymerization solution supply tank which is not shown in the drawing, duct 21 is connected to the atmosphere and duct 22 can be connected to a pumping system 28 by means of the valve 25.

The container also has a piston 27 with holes 28, so as to be able to maintain the composite roll 11 on the support 14, whilst still permitting the passage of air or a liquid.

For performing the final stages of the process according to the invention, the composite roll 11 is introduced into the container 12 and it is kept at the bottom of the container by the piston 27. As the valve 25 is closed and the valve 23, 24 open, into the container is introduced a polymerization solution, whose composition is identical to that used previously and which is also prepared at the time of use, as in the case of FIG. 1. When the container 12 is filled with solution, the valves 23, 24 are closed, the valve 25 opened and the pumping system 26 started up in order to lower the pressure in the container to a value of approximately $10^{-3}$ mbar. In this way the air contained in the composite roll is eliminated in order to facilitate the penetration of the polymerization solution and its circulation in the free space between the layer 1 and the support sheet 3 by the roughnesses 4. The system is then restored to atmospheric pressure by closing the valve 25 and opening the valve 24. This is followed by several cycles of placing under vacuum and then under atmospheric pressure in order to permit a good wetting of the composite roll 11. Following these cycles, the container 12 is maintained at atmospheric pressure for the desired time, preferably operating at a temperature of 5° to 10° C. in order to slow down the polymerization kinetics, guarantee a good attachment of the conductive polymer to the layer and thus give the end product the optimum conductivity and optimum stability in time.

At the end of the operation, the cover 19 is removed, the piston 27 raised, the composite roll 11 extracted and then unwound in order to separate the layer 1 from the support sheet 3. The layer covered with the electronically conductive polymer is then washed and dried, e.g. in a tepid air flow.

According to a variant of the process according to the invention, there are several polymer depositions on the layer, by repeating at least once the stages e) and f) of the process according to the invention, in order to improve the electrical conductivity of the treated layer and give it a very low surface resistance. In this case, at the end of the time for the first deposit, the cover 19 is removed, the piston 27 raised, the drain valve 18 opened in order to drain the polymerization solution from the container, followed by the washing of the composite roll retained by the support 14 with a pressurized water jet in order to eliminate the excess polymer. After this washing, the valve 18 is closed, the cover 19 restored and into the container is again introduced through the pipe 20, whilst performing several cycles of placing under vacuum and returning to atmospheric pressure, as hereinbefore, in order to facilitate the wetting of the layer by the polymerization solution.

The polymerization then takes place in order to carry out the supplementary polymer deposition and the sequence of operations as described hereinbefore.

The process according to the invention has numerous advantages. Thus, by preparing the polymerization solution at the time of use by mixing a first solution of the precursor monomer and the doping agent and a second solution of the oxidizing agent, it is possible to aid formation of the polymer on the textile layer and avoid the polymer precipitating in solution.

Compared with known processes using the successive spraying of solutions of monomers and an oxidizing agent solution onto a fabric layer, the process according to the invention makes it possible to reduce the product quantities used for covering the conductive polymer, an equivalent textile surface having the same final surface resistance. It also improves the polymer deposition efficiency, because there is only a small polymer quantity (e.g. pyrrole black) in the waste waters and it can be applied to the treatment of large layers.

This process is easier to perform on an industrial scale, because it requires little manual intervention, little energy and a very reduced machine occupation time, except in the case of the container where the polymerization takes place, as well as small solution volumes, so that it is economic by reducing waste water quantities.

Moreover, as it is largely a static process, it can be used for the treatment of layers having a limited mechanical strength, such as paper and textile layers.

The following illustrative and non-limitative examples illustrate the production of conductive textiles by the process according to the invention.

EXAMPLE 1

In this example use is made of the process according to the invention for Covering with polypyrrole a 60 g/m$^2$ woven polyester textile (32 threads per weft, 44 threads per warp), constituted by a layer of length 1.50 m and width 1.20 m.

The layer 1 is placed on a polyethylene sheet 3 having no roughnesses and onto the layer is sprayed 0.1 l of a polymerization solution from the tank 7, obtained by mixing 50 vol. % of an aqueous, $4.10^{-1}$ mole/l $FeCl_3$ solution from tank 10 and 50 vol. % of an aqueous 1.74.10 mole/l pyrrole solution and $5.8.10^{-2}$ mole/l of 2-naphthalene sulphonic acid from tank 9. After application of the polymerization solution, the polyethylene textile is wound in order to form the composite roll 11, which is then introduced into the container 12 of FIG. 2.

Into said container is then introduced 0.5 l of the same polymerization solution as that used previously, the valve 23 is then closed and several vacuumizing cycles are then performed at $4.10^{-1}$ Pa ($4.10^{-3}$ mbar) by starting up the pump 26 and opening the valve 25 and placing under atmospheric pressure by opening the valve 24. The container is then maintained at atmospheric pressure and a temperature of 7° C. for 7 h and then the composite roll is removed from the container. The textile layer is separated from the polyethylene sheet and said layer is rinsed with water and then dried. It is found that the polyester fabric is covered with a uniform polypyrrole coating, the electric surface resistance of the fabric is 266 $Ohm^2$.

EXAMPLE 2

The operating procedure of example 1 is used for covering with polypyrrole a polyester textile layer identical to that of FIG. 1, but instead of using 2-naphthalene sulphonic acid, use is made of 2,6-naphthalene disulphonic acid disodium salt at the same concentration in the polymerization solution. Under these conditions, the electric surface resistance of the textile is 128 $Ohm^2$.

EXAMPLE 3

The operating procedure of example 2 is used, but after keeping the composite roll in container 12 for 7 h, the container is emptied and the composite roll is then rinsed and dried in the container. This is followed by a second polypyrrole deposition by again introducing into said container 0.5 l of the same polymerization solution, performing alternate cycles of placing under atmospheric pressure and vacuum and keeping a temperature of 7° C. for 7 h.

Following this second polypyrrole deposition cycle, the composite roll is removed from the container, the textile separated from the polyethylene sheet and the textile is rinsed and dried as in example 1. The electric surface resistance of the textile is 59 $Ohm^2$.

EXAMPLE 4

A polyester textile covered with polypyrrole is prepared by using the operating procedure of example 3, but following the second deposition cycle by a third polypyrrole deposition cycle for 7 h at 7° C. under the same conditions as in the first and second deposition cycles. The electric surface resistance of the textile treated in this way is 42 $Ohm^2$.

Table 1 gives the conditions and results obtained in examples 1 to 4.

TABLE 1

| Example | Support sheet | Doping agent | Number of deposition cycles | Square electric resistance ($Ohm^2$) |
|---|---|---|---|---|
| 1 | polyethylene | 2-naphthalene sulphonic acid | 1 | 266 |
| 2 | polyethylene | disodium 2,6-napthalene disulphonate | 1 | 128 |
| 3 | polyethylene | disodium 2,6-napthalene disulphonate | 2 | 59 |
| 4 | polyethylene | disodium 2,6-napthalene disulphonate | 3 | 42 |

EXAMPLES 5 TO 13

In these examples, a woven polyester textile layer identical to that of example 1 is covered with polypyrrole, following the same operating procedure as in example 2 (a single deposition cycle), example 3 (two deposition cycles under the same conditions), or example 4 (three deposition cycles under the same conditions), but the support sheet is constituted by a polyethylene sheet having roughnesses formed by air bubbles and optionally other doping agents.

In these examples, the polymerization solution composition is $0.87.10^{-1}$ mole/l of pyrrole, $2.10^{-1}$ mole/l of $CeCl_3$ and $2.9.10^{-2}$ mole/l of doping agent and corresponds to that of examples 1 to 4.

In all cases, a conductive textile is obtained having the impression of the bubbles of the polyethylene support sheet, which has a uniform electrical resistance over its entire surface.

The number of deposition cycles, the doping agents used and the electrical resistance obtained are given in the following table 2.

TABLE 2

| Example | Doping agent | Number of deposition cycles | Square electrical resistance ($Ohm^2$) |
|---|---|---|---|
| 5 | disodium 2,6-naphthalene disulphonate | 1 | 28.9 |
| 6 | disodium 2,6-naphthalene disulphonate | 2 | 17 |
| 7 | disodium 2,6-naphthalene disulphonate | 3 | 9.5 |
| 8 | $Fe^{III}$ 1,5-naphthalene disulphonate | 1 | 26.7 |
| 9 | $Fe^{III}$ 1,5-naphthalene disulphonate | 2 | 13.7 |
| 10 | $Fe^{III}$ 1,5-naphthalene disulphonate | 3 | 9.2 |
| 11 | disodium 1,5-naphthalene disulphonate | 1 | 33.2 |
| 12 | disodium 1,5-naphthalene disulphonate | 2 | 14.7 |
| 13 | disodium 1,5-naphthalene disulphonate | 3 | 9.4 |

On the basis of the results of table 2, it can be seen that the square electrical resistances of the conductive fabrics are very low and significantly decrease with the number of deposition cycles performed. Thus, it is possible to obtain conductive textiles with a square electrical resistance of 5 to 20 $Ohm^2$.

EXAMPLES 14 TO 24

These examples use the same operating procedure as in example 1 for covering with polypyrrole an unwoven 72 $g/m^2$ polyester textile having the same dimensions as that of example 1, but using different doping agents, a support sheet which can be a polyethylene sheet, which may or may not have air bubbles, and performing one or more deposition cycles under the same conditions as described in examples 3 and 4.

The support sheets, doping agents used, the number of deposition cycles performed and the electrical resistance obtained are given in table 3.

In all cases, a uniform surface resistance is obtained, even when the conductive textile has the impression of the support sheet bubbles.

The results obtained in the examples demonstrate that it is possible to obtain with the process according to the invention electrically conductive textiles having very low square electrical resistances, namely below 50 $Ohm^2$, preferably 5 to 45 $Ohm^2$ and still better 5 to 20 $Ohm^2$.

Electrically conductive textiles of this type can be used in the car sector for producing heated seats, in the building sector for low temperature radiant panel heating, in the medical field for producing heated gloves for treating patients suffering from symmetric gangrene, heated lumbar belts, heated mattresses and blankets, etc. They can also be used for producing heated clothing for winter sports.

Textiles with low electrical conductivities obtained by the process according to the invention can have interesting applications in fields other than heating, e.g. for the flow of electrostatic charges in the packing of electronic components, the coating of floors and partitions of clean rooms and the production of antistatic clothing.

The textiles obtained by the process of the invention can also be used for electromagnetic shielding, e.g. in protecting electronic equipment against electromagnetic interference and the attenuation of electromagnetic emissions of certain electrical equipment.

The electrically conductive fabrics obtained by the process according to the invention can finally be used for producing metallized textile surB faces, e.g. using copper or nickel, by electrochemical deposition on conductive textiles.

TABLE 3

| Example | Support sheet | Doping agent | Number of deposition cycles | Square electrical resistance ($Ohm^2$ |
|---|---|---|---|---|
| 14 | polyethylene | 2-naphthalene sulphonic acid | 1 | 884 |
| 15 | " | disodium 2,6-naphthalene disulphonate | 1 | 503 |
| 16 | polyethylene with bubbles | disodium 2,6-naphthalene disulphonate | 1 | 109.2 |
| 17 | polyethylene with bubbles | disodium 2,6-naphthalene disulphonate | 2 | 22.6 |
| 18 | polyethylene with bubbles | disodium 2,6-naphthalene disulphonate | 3 | 8.5 |
| 19 | polyethylene with bubbles | $Fe^{III}$ 1,5-naphthalene disulphonate | 1 | 60.2 |
| 20 | polyethylene with bubbles | $Fe^{III}$ 1,5-naphthalene disulphonate | 2 | 21.4 |
| 21 | polyethylene with bubbles | $Fe^{III}$ 1,5-naphthalene disulphonate | 3 | 10.5 |
| 22 | polyethylene with bubbles | disodium 1,5-naphthalene disulphonate | 1 | 135.7 |
| 23 | polyethylene with bubbles | disodium 1,5-naphthalene disulphonate | 2 | 19.2 |
| 24 | polyethylene with bubbles | disodium 1,5-naphthalene disulphonate | 3 | 10.4 |

We claim:

1. Process for the preparation of a porous material layer covered with an electronically conductive polymer by in situ polymerization of a precursor monomer of the electronically conductive polymer by means of an oxidizing agent, characterized in that it comprises the following stages:

a) placing the porous material layer on an impermeable, flexible support sheet made from a material inert under the polymerization conditions of the precursor monomer, b) applying to the layer on the support sheet a polymerization solution comprising the precursor monomer, the oxidizing agent and a doping agent, c) winding the assembly formed by the support sheet and the thus treated layer in order to form a composite roll, d) introducing the composite roll into a container, e) filling the container with a polymerization solution comprising the precursor monomer, the oxidizing agent and the doping agent and f) maintaining the composite roll in the container filled with the polymerization solution for an adequate time to polymerize the precursor monomer and form on the layer a conductive polymer covering.

2. Process according to claim 1, characterized in that stages e) and f) are repeated at least once after washing with water the composite roll in order to eliminate excess conductive polymer.

3. Process according to claim 1, characterized in that the support sheet has roughnesses so as to provide a space in which liquid can be retained between the support sheet and the porous material layer.

4. Process according to claim 1, characterized in that the support sheet is of polyethylene.

5. Process according to claim 3, characterized in that the support sheet is a polyethylene sheet having air bubbles forming roughnesses.

6. Process according to claim 3, characterized in that the support sheet is an embossed polyethylene sheet.

7. Process according to claim 1, characterized in that the precursor monomer is pyrrole and the oxidizing agent ferric chloride.

8. Process according to claim 1, characterized in that the doping agent is a sulphonic acid or a sulphonic acid salt.

9. Process according to claim 7, characterized in that the doping agent is chosen from among the disodium salts and ferric salts of naphthalene disulphonic acids.

10. Process according to claim 1, characterized in that the polymerization solution is prepared by mixing, at the time of its use, a first aqueous solution of the precursor monomer and the doping agent with a second aqueous solution of the oxidizing agent.

11. Process according to claim 1, characterized in that the porous material layer is a textile layer.

* * * * *